US008647547B2

(12) United States Patent
Coles

(10) Patent No.: US 8,647,547 B2
(45) Date of Patent: Feb. 11, 2014

(54) PROCESSING OF LIGNOCELLULOSIC AND RELATED MATERIALS

(75) Inventor: Graeme Douglas Coles, Amberley (NZ)

(73) Assignee: Lignotech Developments Limited (NZ)

( * ) Notice: Subject to any disclaimer, the term of this patent is extended or adjusted under 35 U.S.C. 154(b) by 735 days.

(21) Appl. No.: 12/705,663

(22) Filed: Feb. 15, 2010

(65) Prior Publication Data

US 2011/0000631 A1 Jan. 6, 2011

(51) Int. Cl.
*D21B 1/36* (2006.01)

(52) U.S. Cl.
USPC ..... 264/115

(58) Field of Classification Search
USPC ..... 264/115, 120
See application file for complete search history.

(56) References Cited

U.S. PATENT DOCUMENTS

| | | | | |
|---|---|---|---|---|
| 1,578,609 | A | 3/1926 | Mason | |
| 2,008,892 | A | 7/1935 | Asplund | |
| 2,303,345 | A | 12/1942 | Mason | |
| 2,800,945 | A | 7/1957 | Schilling | |
| 2,964,416 | A | 12/1960 | Glab | |
| 3,199,213 | A | 8/1965 | Milligan | |
| 4,152,197 | A | 5/1979 | Lindahl | |
| 4,431,479 | A | 2/1984 | Barbe | |
| 4,599,138 | A | 7/1986 | Lindahl | |
| 4,751,034 | A | 6/1988 | DeLong | |
| 5,017,319 | A | 5/1991 | Shen | |
| 5,023,097 | A | 6/1991 | Tyson | |
| 5,328,562 | A | 7/1994 | Rafferty | |
| 5,705,216 | A | 1/1998 | Tyson | |
| 6,128,831 | A * | 10/2000 | Durance et al. | 34/412 |
| 6,306,248 | B1 | 10/2001 | Eley | |
| 6,409,841 | B1 | 6/2002 | Lombard | |
| 6,610,232 | B2 | 8/2003 | Jacobsen | |
| 7,303,707 | B2 | 12/2007 | Rafferty | |
| 7,332,119 | B2 | 2/2008 | Riebel | |
| 2001/0052657 | A1 | 12/2001 | Jacobsen | |
| 2005/0173824 | A1 | 8/2005 | Rafferty | |
| 2007/0036958 | A1 | 2/2007 | Hagemann | |
| 2009/0110654 | A1 | 4/2009 | Hagemann | |
| 2010/0216202 | A1 * | 8/2010 | Fosbol et al. | 435/165 |

FOREIGN PATENT DOCUMENTS

| | | |
|---|---|---|
| CA | 1211913 | 9/1986 |
| CA | 2027848 | 4/1991 |
| DE | 4033849 | 4/1991 |
| EP | 346559 | 12/1989 |
| EP | 373726 | 6/1990 |
| EP | 0492016 | 7/1992 |

(Continued)

OTHER PUBLICATIONS

Smook G.A., Handbook for pulp and Paper Technologists, TAPPI, 1982, p. 29.

*Primary Examiner* — Larry Thrower
*Assistant Examiner* — Xue Liu
(74) *Attorney, Agent, or Firm* — Galbreath Law Offices, P.C.; John A. Galbreath

(57) ABSTRACT

A method for processing lignocellulosic precursors that includes the following steps:

A. provide a suitably sized lignocellulosic precursor with less than 11% moisture content;

B. pack a hydrothermal processing vessel with between 1 and 3 times the free flow volume of the lignocellulosic precursor;

C. subject the lignocellulosic precursor in the hydrothermal processing vessel to steam below 100 bar for up to 10 minutes;

E. explosively decompress to ambient pressure;

and then dry the resultant lignocellulosic product to below about 15% moisture content.

11 Claims, 1 Drawing Sheet

(56) References Cited

FOREIGN PATENT DOCUMENTS

| | | |
|---|---|---|
| EP | 0642898 | 3/1995 |
| EP | 1033212 | 9/2000 |
| JP | 2000 246707 | 3/1999 |
| WO | WO 03039825 | 5/2003 |

* cited by examiner

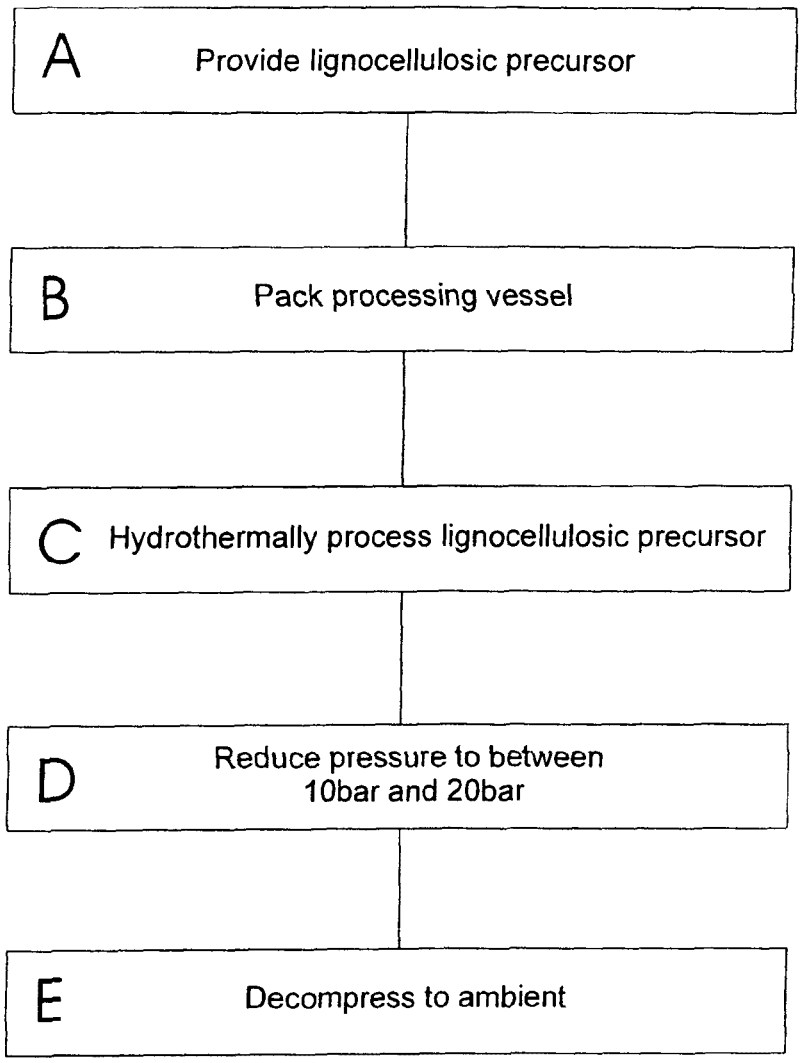
A
Provide lignocellulosic precursor
B
Pack processing vessel
C
Hydrothermally process lignocellulosic precursor
D
Reduce pressure to between 10bar and 20bar
E
Decompress to ambient

PROCESSING OF LIGNOCELLULOSIC AND RELATED MATERIALS

TECHNICAL FIELD

This invention relates to a method of processing a lignocellulosic precursor to produce a material that can be used to produce a range of useful end products including composite products such as panel boards. Noting that herein the term lignocellulosic precursor refers to a natural material, preprocessed or otherwise, that contains lignin, hemicellulose, lignocellulose or cellulose, alone or in combination.

BACKGROUND ART

Any discussion of the prior art throughout the specification is not an admission that such prior art is widely known or forms part of the common general knowledge in the field.

It is known to produce composite products from waste products containing cellulosic materials by chemically transforming the natural sugars into a bonding and bulking agent by the application of heat and pressure. Such methods have been used for many years and one well-known method is generally called 'explosion hydrolysis'. That method consists in placing the material to be processed in a strong closed vessel, passing high-pressure steam into the vessel for a specific period and then opening the vessel in such a manner that the material explodes out of the vessel. In particular the explosion process affects hemicellulose, which is a non-structural component of woody material. During the explosion process hemicellulose is broken down initially into simpler sugars, which are further transformed with other products during the explosion process to form the resinous material that bonds the product.

U.S. Pat. No. 1,578,609 granted in 1926 to William H Mason of USA described a process and apparatus for the disintegration of lignocellulosic material. The method consisted in the chipping of small pieces of timber, placing them in a closed high pressure chamber, commonly known as a 'gun' and subjecting the material to pressure by steam, compressed air or the like. After sufficient time to allow the gases to penetrate the wood and to establish a balance of pressure and temperature in the wood, an outlet valve of comparatively small dimension is opened to cause the material to be forcibly driven out of the chamber through the valve opening. As the pieces of wood emerge, they are progressively disintegrated.

This method, described in U.S. Pat. No. 1,578,609, has subsequently become known as 'explosion hydrolysis' and further discussion on this method can be found in the specification of U.S. Pat. No. 2,303,345 (Mason and Boehm), which describes a process for making products from lignocellulosic material by using high pressure steam in a gun to separate the lignin from ligno-cellulose and to hydrolyse the hemicellulose into water-soluble material.

The disadvantage with the process disclosed in the U.S. Pat. No. 2,303,345, known as the 'Masonite' process, is that it produces a water-soluble adhesive so that the adhesive bond formed by the Masonite process tends to liquefy with a consequent deterioration of the quality of the product.

U.S. Pat. No. 5,017,319 (Shen), discloses a process for converting hemi-cellulosic materials into a thermoset waterproof adhesive. The process consists in bringing lignocellulosic material which contains at least 10% hemicellulose into contact with high pressure steam to decompose and hydrolyse the hemicellulose into a resin material without significant carbonisation of the hemicellulose. The material is then heated and pressed against a surface to thermoset and adhere the material to the surface.

U.S. Pat. No. 5,328,562 (Rafferty and Scott), describes a process and an apparatus for producing a lignocellulosic product whereby the lignocellulosic material is hydrolysed in a primary zone and the product is moved from the primary zone to a secondary zone into which superheated steam bled from the primary zone is introduced under sufficient pressure to dry the hydrolysis products. This specification is concerned with a continuous energy re-circulation system so there will be a minimum of waste energy in the process.

It is also well known that the quality of a product formed by the explosion process depends largely on how well the adhesive polymer produced during the explosion process is spread throughout the material and how well the material is compacted. The temperature during the process is very important because if the temperature is too high, degradation of the natural sugars would occur and this would produce water and reduce the efficiency of the surface coating and of the adhesive resulting in a weaker and less water-repellent product. If the temperature is too low, a less efficient dispersal of the adhesive polymer occurs and that would result in a product that might not have the desired qualities. Therefore the water content management of the process is vital for good process performance.

In addition, it is known that both furan and hydroxymethylfuran, which are sugars from which water has been removed, are often present in the processed product. This can occur at high temperatures where there is little free water and where reactions occur which demand water, such as when lignin is being broken down. Furans are reactive and will readily take part in the lignin repolymerisation process and even small amounts will assist to link together large molecules in the processed product. Consequently it is necessary to control the amount of moisture very closely to produce a satisfactory product.

In U.S. Pat. No. 7,303,707 (Rafferty '707) the hydrothermal processing of lignocellulosic materials with between 11% and 25% moisture by hydrothermal processing is discussed. The inventors indicate that around 16% moisture content in the feedstock is optimum. Materials with an initial moisture content outside 11% to 25% are not felt suitable for processing, and in fact the document does not mention processing of materials outside this range. Rafferty '707 indicates that the initial moisture content is an important consideration and uses dry saturated or slightly (up to 5° C.) superheated steam to process the lignocellulosic material. There are many natural materials containing lignin, hemicellulose or cellulose, alone or in combination, that fall outside of the 11% to 25% range proposed. For example large quantities of Distillers Dry Grain (DDG), Distillers Dry Grain and Solubles (DDGS) and spent corn used for ethanol production are dried to below 11% for storage, thus fall outside this 11% to 25% moisture content range. Given Rafferty '707 indicates that the moisture content should be between 11% and 25%, preferably 16% it apparently discounts processing materials outside this range. Given the control of moisture content is critical to the process the moisture content of the raw material is carefully controlled. The use of dry saturated steam (with up to 5° C. superheat) is indicated in Rafferty '707, this again confirms that careful control of the moisture content of the raw material and water present for the reactions inside the hydrothermal pressure vessel are carefully controlled. They reinforce the message that careful control of moisture content is critical to producing a useful product.

US Published Patent Application Number 2009/0110654 is directed to providing a low odour biocomposite by processing lignocellulosic material by the method described in U.S. Pat. No. 7,303,707. US 2009/0110654 does not introduce any method of hydrothermally processing lignocellulosic material outside of that disclosed in U.S. Pat. No. 7,303,707. For example, US 2009/0110654 specifically discloses the process described in U.S. Pat. No. 7,303,707 in paragraph 0010, referring to it by its application Ser. No. 10/494,646 and calling it the Lignotech method:

"U.S. patent application Ser. No. 10/494,646, published on Aug. 11, 2005, teaches a method of processing lignocellulosic material using hydrothermal pressure vessel, the entire disclosure of which is incorporated by reference. This method includes steps of comminuting of the material, drying, subjecting the material packed vessel to steam under pressure, and then drying the processed material to a specific moisture content. This method is referred to as LignoTech and may be utilized as one method of preparing a biological material to be integrated with a plastic material and an odor controlling agent in some embodiments of the present invention."

When the 'Lignotech process' is discussed later in US 2009/0110654 (paragraph 0072) the exact range of moisture content taught by U.S. Pat. No. 7,303,707 is specified:

"When the biological material is dried in moving air, the air velocity is regulated along with the temperature of the air to ensure adequate drying of the material, preferably to a moisture content between 11% to 25%, although a higher moisture content may also work for some applications. The best results have been obtained with the dried material with around 16% moisture content."

At no point in US 2009/011654 is any method other than the 'Lignotech process' discussed, and it teaches very careful control of moisture content for the process. There is no positive disclosure in US 2009/011654 or U.S. Pat. No. 7,303,707 of a process using a feedstock moisture content below 11%, thus any references to below 25% moisture content teach only 11% to 25% moisture content in the feedstock.

US 2009/011654 is directed to a de-odorising solution for bio-plastic composite materials, a combination of polymers and filler materials such as DDG, when hydrolysing is mentioned in the examples, see paragraph 0107, it specifically states:

"Next, the biological material particulate is dried appropriately for a hydrolysis process."

The only hydrolysis process mentioned or discussed is that described in U.S. Pat. No. 7,303,707, which specifies a moisture content of between 11% and 25%. Processing outside of this moisture content range is taught away from.

One further disadvantage with many of the hydrothermal explosive decompression processes described above is the stress applied to the valve used to decompress and eject the material processed. With processes decompressing from 30 bar, or higher, to atmospheric, in 2 seconds or less, the valves used either have a short life or are very expensive (often both).

It is an object of the present invention to provide a means of processing lignocellulosic materials.

DISCLOSURE OF INVENTION

The present invention provides a method for processing lignocellulosic precursors that includes the following steps:

A. provide a suitably sized lignocellulosic precursor with preferably less than 11% moisture content;

B. pack a hydrothermal processing vessel with the lignocellulosic precursor;

C. subject the lignocellulosic precursor in the hydrothermal processing vessel to steam below 100 bar for up to 10 minutes;

E. explosively decompress to ambient pressure;

Preferably step D is undertaken between step C and E, where step D is as follows:

D. slowly reduce the pressure to between 10 and 20 bar;

Preferably step E is followed by cooling to ambient and drying the resultant product to below 15% moisture content. In a highly preferred form the drying is carried out without first cooling to ambient.

Preferably the initial moisture content of the lignocellulosic precursor is between 5% and 10%. In one preferred form the moisture content is below 25%.

Preferably the density of lignocellulosic precursor in the hydrothermal processing vessel is between 1 and 3 times the free flow density.

Preferably the water activity of the lignocellulosic precursor and the steam used in processing step C are measured and/or predetermined. Preferably the water activity of the precursors determines the required water activity of the steam used. Preferably the steam is dry, saturated or superheated steam.

In a highly preferred form the lignocellulosic precursor is plant material, DDG, DDGS, corn, fungi, algae, wood, bark, a grass or similar with a moisture content between 0% and 11%. Most preferably a lignocellulosic precursor from ethanol production such as DDG or DDGS is used.

Preferably the steam is between 20 bar and 60 bar. Preferably the processing is for between 30 seconds and 5 minutes. Preferably step D takes between 6 and 20 seconds.

Preferably the pressure in step D is 15 bar.

Preferably the dried product is blended with plastic material to form a blended material, such that the plastic material makes up between 5% and 95% of the blended material, said plastics material being waste and/or virgin material. Preferably the plastic material is a thermoplastic or thermosetting plastic. In a highly preferred form the plastic is a thermoplastic selected from polyethylene and polypropylene with or without additional compatible additives.

Preferably the blended material is extruded to form pellets or granules ready to be used to manufacture other products.

BRIEF DESCRIPTION OF DRAWINGS

By way of example only, a preferred embodiment of the present invention is described in detail below with reference to the accompanying drawings, in which:

FIG. 1 is a flowchart showing the method of processing lignocellulosic precursors;

BEST MODE FOR CARRYING OUT THE INVENTION

Lignocellulosic Precursors:

The definition of Lignocellulosic precursor used herein is as follows: a material that contains one or more of the following chemical species:—lignin, lignocellulose, cellulose, and hemicellulose. The material may be a natural material or a processed natural material containing one or more of the abovementioned species. Lignocellulosic precursors include (but should not be seen as limited to) the following: the products from ethanol production from grain and corn, Distillers Dried Grain (DDG), Distillers Dried Grain and Solubles (DDGS), Corn, *pinus radiata* sawdust and chippings, wood sawdust, wood bark, paper, grasses (including bamboo), fungi, algae, all either as naturally occurring or as processed material (waste or otherwise).

The lignocellulosic precursor may be available at below 11% moisture content, or need to be pre-processed into this range. This pre-processing may involve drying (in still or moving air—heated or not), freeze drying, desiccant drying, solvent drying (where a solvent is used to remove the water), vacuum drying, removing the water by microwave/infra-red/direct heating or any similar method. It should be noted that as the preferred method of determining moisture content involves the further drying of the precursor to a constant mass at 105° C., a solvent dried lignocellulosic precursor may give an erroneously high moisture content due to solvent rather than water losses. For this reason water activity (as defined below) may be a better indication of the processing conditions required.

For use in the process the lignocellulosic precursor should be below 11% moisture content and be properly sized. Normally the precursor will be sized prior to drying as this increases the surface area available for moisture removal, but it is not essential. Many materials will already be suitably sized, for example grain/corn based materials (such as DDG and DDGS) are. Other lignocellulosic precursors to be processed are comminuted to a size that will enable the material to be gunned in known hydrothermal pressure vessels. In a highly preferred form, the material is comminuted to a size that will fall within the range of length up to 40 mm, width up to 6 mm and a height of up to 6 mm. In a yet more highly preferred form, the thickness of the material to be processed will be no greater that 5 mm. It is however to be understood that under certain circumstances, it is possible to process material of a greater size than set out above and this disclosure is not to be restricted to the preferred ranges.

Referring to FIG. 1 the preferred processing method is shown, this method includes the following steps, in order:

A. provide a suitably sized lignocellulosic precursor with preferably less than 11% moisture content;
B. pack a hydrothermal processing vessel with the lignocellulosic precursor;
C. subject the lignocellulosic precursor to steam below 100 bar for up to 10 minutes;
D. slowly return the pressure to between 10 and 20 bar;
E. explosively decompress to ambient pressure;

In step A lignocellulosic material with between 0% and 11% moisture content, as measured by further drying to constant mass at 105° C., is sized to fit into the hydrothermal processing vessel (a high pressure vessel with an inlet and an outlet valve). The method of measuring the moisture content is not important, only the moisture content itself (noting that for solvent dried materials this 'moisture' may in fact be solvent losses). For example DDG's typically have around 8% moisture when measured in this way after being used for ethanol production, and they are approximately the right size for processing without further sizing. Bark however may need to be dried to be below 11% moisture content and is likely to need the particle size adjusted.

Water Activity

In step A the water activity may also be calculated, where the water activity is the water vapour pressure above a sample divided by the vapour pressure of pure water at the same temperature. This FIGURE has been found to relate better to the required processing conditions than the moisture content, however the moisture content is easier to measure. Thus the method may in the future depend not on the moisture content but the water activity.

In step B the lignocellulosic material is packed into the hydrothermal processing vessel. This packing forces the density of precursor in the processing vessel to between 1 and 3 times the free flowed density. The free flowed density is the bulk density of the lignocellulosic precursor without any compression applied to force it into the vessel (i.e. the density of the free flowed precursor). For example if 50 g of a lignocellulosic precursor may be freely poured into a 100 ml container then between 50 g and 150 g of lignocellulosic precursor would be packed into a 100 ml hydrothermal processing vessel. Though preferably this is between 1 and 1.5 times the free flowed density, the actual packing density is determined by the lignocellulosic precursor's density and moisture content. This packing may be accomplished by any known means, for example mechanically pressed into the vessel or the application of a vacuum.

If necessary for processing a preset quantity of water may be added before sealing the hydrothermal processing vessel. The quantity of water added would be determined by the water activity of the lignocellulosic precursor and the water activity of the steam to be used.

In step C the packed lignocellulosic precursor is hydrothermally processed using steam, and it is preferred that the steam is dry or superheated. However, if the water activity of the lignocellulosic precursor requires the use of wet steam or water injection to produce the required product then this can be used. The quality and amount of steam used, and the processing time overall, depends on the required product. In general the pressure and temperature are selected to ensure the material is not burnt and there is no undue deterioration of its physical characteristics, but some lignocellulosic precursors may result in odoriferous compounds being produced.

The consumption of steam will depend on i. The chemical reaction required;
ii. The projected end use of the processed material;
iii. The time and pressure for a specific reaction;
iv. The time the material is in the hydrothermal reactor before the required pressure is built up;
v. The type of lignocellulosic precursor being processed;
vi. The temperature and the amount of moisture of the material packed into the reactor, and/or the water activity of the precursor and/or steam used.

Following the completion of step C, step D is undertaken, here the pressure is reduced to around 15 bar (normally between 10 bar and 20 bar) in the processing vessel. Then step E is undertaken and the pressure is dropped to ambient within about 3 seconds or less, i.e. the hydrothermal processing vessel is explosively depressurised to complete the processing. By reducing the pressure first to around 15 bar (over around 6 to 10 seconds) then explosively to atmospheric it has been found that the valves last longer. Noting that if the hydrothermal processing vessel is very large the explosive decompression may take longer than 3 seconds.

Noting that step D, the slow reduction to between 10 bar and 20 bar, is preferred but optional. It has been found that the life of the valve is significantly extended if this two stage decompression is adopted. Surprisingly the product quality does not appear to be affected by the explosive decompression being carried out at between 10 and 20 bar rather than directly from the processing pressure. The 'slow' (between about 6 and 20 seconds) decompression step (step D) however does extend the valve life. This result is unexpected as other workers in the field have indicated that the explosive decompression is critical to the process, thus slowly reducing the pressure before the explosive decompression step is counter-intuitive. The steam bled off during step D can be used in other parts of the process, for example assisting with the drying or preheating the moulds or platens used to form the final product.

Preferably, immediately the product is discharged from the processing vessel, it is cooled to prevent further chemical reaction and the product is then dried in moving air, preferably in a cyclone, at a temperature below 90° C. and preferably above 55° C. and more preferably below 75° C. The hydrolysed dried product will preferably have a moisture content of between 1% and 10% and more preferably 3%. The hydrolysed lignocellulosic product may be dried in a number of ways; for example, one suitable drying technique is disclosed in U.S. Pat. No. 5,236,132. As an alternative the drying may occur shortly after processing without cooling to ambient, but this can depend on the product being processed.

The dried product can then be stored for later processing, such as injection molding. If the material is to be utilized to form panel board and the like it will be pressed and cured for a time and at a temperature which will provide the desired characteristics and properties of the resultant product. In a highly preferred form the temperature can be within the range of between 40° C. to 200° C. but more preferably it will be between 60° C. and 200° C. with the pressure and the time profile determining the properties of the resultant product. These properties can vary from water resistant and dense through to very high density and strength or to relatively porous with low water resistance.

It should be noted that where the term 'lignocellulosic precursor' is used it may in fact be a blend of materials falling under this term. That is, it could, for example, be a blend of DDG, sawdust and fungi each having a different moisture content (water activity).

Thus it has been found possible to produce a panel board having the following features:

A density between 400 kg/m$^3$ and 1800 kg/m$^3$.

A thickness between 3 mm and up to 50 mm and possibly up to 400 mm or more.

Materials having moisture resistance from low to complete.

Mechanical properties similar to the Australian HMR standard.

The dried hydrolysed lignocellulosic product has been processed successfully in the following products:—

1. Pressing and moulding to form compressed waterproof board having a density in the range of 400-1800 kg/m$^3$. Preferably the platen temperature is kept within the range of 120° C. to 210° C. while the press time will be determined by the density required in the finished product. As an example, the press time for a density of 1600 kg/m$^3$ will be approximately 240 seconds, while for a density of 600 kg/m$^3$, the press time is 15 minutes.
2. Injection moulding to form solid shapes, for example shipping containers.
3. Forming a biocomposite material by blending the product with virgin/waste plastics material then extruding it to form pellets suitable for further injection moulding, forming or extrusion into desirable shapes.
4. A composite board material made with powdered thermosetting resins and powdered lignocellulosic product, in this case the lignocellulosic product may need to be reduced in size by milling or a similar process. Alternatively the lignocellulosic product may be used in the dried un-milled form for some applications.

For the biocomposite material the plastic is normally a thermoplastic material, either virgin or waste plastic being used. The thermoplastic may be a blend of two or more compatible thermoplastics. The preferred thermoplastics are polyethylene or polypropylene, partly because the volume of polythene (high density and low density) waste in most countries is very high and land fill disposal is problematic. The blending of between 5% and 95% lignocellulosic product with a thermoplastic material can be used to make pellets or granules that can be used in existing equipment for injection moulding, forming or extrusion of plastics.

EXAMPLES

The moisture content of the lignocellulosic precursor was determined by drawing a representative sample, and testing using a moisture balance (Sartorius MA100). The moisture measurement programme consists of loading approximately 5 grams of sample on to the balance, after first taring it with a fresh pan. The balance determines the starting mass, then heats the sample using infrared radiation, monitoring the loss of mass due to sample evaporation until it ceases. The balance then records the final mass and calculates the moisture content (%) using the function (initial mass−final mass)/initial mass×100. The balance temperature is set to 105° C., and this temperature is maintained throughout the test.

Example 1

Distillers Dried Grains and Solubles, also known as (DDGS), a lignocellulosic byproduct of industrial ethanol production from Maize (*Zea mays*), was obtained from Hartington Feed & Chick, Hartington, Nebr., USA.

60 kg±0.5 kg of DDGS at a moisture content of 8.64%. was loaded into a hydrothermal pressure vessel. The pressure vessel was closed and 19.81 kg of dry steam admitted from a boiler operated at 40 bar. The final temperature and pressure achieved in the pressure vessel was 220° C. and 29 bar.

The temperature and pressure were maintained for 120 seconds, and then the pressure reduced in two stages: first over a period of 6 seconds to 15 bar, then explosively to atmosphere. The processed sample was then further dried before evaluation. This process was repeated until a total of 3000 kg of finished product was obtained.

The finished product, when included in a previously-developed formulation for a biocomposite product, performed satisfactorily.

Example 2

Corn Fibre, a lignocellulosic byproduct of bioethanol production from Maize (*Zea mays*) was obtained from Grain Processing Corporation, Muscatine, Iowa USA.

Samples of the corn fibre at a moisture content of 8.5%. were processed in a hydro thermal pressure vessel. A 45 kg±0.5 kg sample of corn fibre was loaded into the vessel, which was then charged with 19.81 kg of dry steam from a boiler operated at 45 bar.

After 80 seconds, the pressure was reduced to 15 bar over a period of 6 seconds, and then the sample was explosively expelled to atmosphere and dried to 2% moisture, determined as for the raw material. This process was repeated until 400 kgs of processed sample was accumulated.

The processed material was then included in the formulation for an experimental biocomposite material.

The processed material performed satisfactorily in the biocomposite formulation.

Example 3

A wide range of materials were hydrothermally processed and compounded with virgin polypropylene (Hyundai Seetec M1600, with an addition of a modified polypropylene, Epolene G3015). The compounds consisted of 40 wt % processed lignocellulosic precursor, 56.5% M1600 and 3.5% G3015. The formulations were prepared by extrusion on a twin screw Labtech extruder type (26 mm co-rotating screws; ID=40) with the following settings:

Temperatures (° C.): 170, 170, 175, 175, 180, 180, 180, 180, 180, 175.

Screw Speed: 200 rpm. Feed screw speed: 20 rpm; Torque: 45%; Die melt pressure: 20 bar. A strand 2 die was used with the extruded material water cooled and pelletised into 2.5 mm pellets. The resultant pellets were dried in a desiccant drier at 60° C. for 3 hours before injection moulding into tensile and flexile test pieces using a BOY 35M injection moulder. Tensile samples were tested according to ASTM D 638 and flexural testing was performed in accordance with ASTM D 790. None of the materials compounded caused any problems during processing or when injection moulded.

The hydrothermal processing was carried out on a 30 kg total charge in the processing vessel. sample 12 was 28 kg of dried corn fibre and 2 kg of water, samples 3, 5, 8 and 11 were 29 kg of the lignocellulosic precursor listed with 1 kg of water and the remaining samples were 30 kg of the lignocellulosic precursor listed. Each sample was processed for between 90 and 180 seconds using about 33 bar steam.

The results for Example 3 appear below in Table 1.

TABLE 1

Example 3 results

| Sample | Lignocellulosic Precursor | Moisture Content (wt %) | Tensile Modulus (MPa) | Tensile Stress (MPa) |
|---|---|---|---|---|
| 1 | Sawdust | 0.2 | 2016 | 25.3 |
| 2 | Sawdust | 1.48 | 1985 | 25.1 |
| 3 | Sawdust* | 1.48 | 1970 | 24.1 |
| 4 | Sawdust | 7.36 | 1806 | 23.62 |
| 5 | Sawdust* | 7.36 | | |
| 6 | DDG | 7.74 | 796 | 16.35 |
| 7 | DDG | 2.31 | 932 | 17.73 |
| 8 | DDG* | 2.31 | 725 | 15.79 |
| 9 | Corn Fibre | 7.66 | 1081 | 18.84 |
| 10 | Corn Fibre | 1.61 | 1235 | 18.07 |
| 11 | Corn Fibre* | 1.61 | 1101 | 18.18 |
| 12 | Corn Fibre* | 1.61 | 1081 | 17.76 |
| 13 | Sawdust 33% + DDG 66% | 2.03 | 930 | 17.51 |
| | 100% Seetec M1600 | NA | 1314 | 22.4 |

*indicates water was added to the hydrothermal processing vessel before hydrothermal processing.

Example 4

A proportion of the hydrothermally processed lignocellulosic precursor from samples 1, 2 and 3 from example 3 was retained unblended. The material was dried to around 0.5% moisture content then pressed at 200° C. and 520 kN for 4 minutes into a 5 mm thick board with a target density of 1200 kg/m$^3$. A number of panels were pressed from each sample and a variety of tests carried out, including an internal bond test according to NZS 4266.6:2004, the results appear below in Table 2:

TABLE 2

Example 4 results:

| Sample | Density range (kg/m$^3$) | Tensile Falling Load (N) | Internal Bond Strength (MPa) |
|---|---|---|---|
| 1 | 1164 to 1216 | 1218 to 2163 | 0.48 to 0.85 |
| 2 | 1128 to 1195 | 1473 to 2693 | 0.58 to 1.05 |
| 3 | 1108 to 1189 | 2163 to 3742 | 0.85 to 1.47 |

The invention claimed is:

1. A method for processing lignocellulosic precursors that includes the following steps:

A. provide a lignocellulosic precursor with less than 25% moisture content ;

B. pack a hydrothermal processing vessel with lignocellulosic precursor, such that the density of lignocellulosic precursor in the hydrothermal processing vessel is between 1 and 3 times the free flow density of the lignocellulosic precursor;

C. subject the lignocellulosic precursor in the hydrothermal processing vessel to steam below 100 bar for up to 10 minutes;

D. slowly, within about 6 to 20 seconds, reduce the pressure within the hydrothermal processing vessel to between 10 and 20 bar;

E. explosively decompress the hydrothermal processing vessel to ambient pressure;

and then dry the resultant lignocellulosic product to below about 15% moisture content.

2. The method for processing lignocellulosic precursors as claimed in claim 1 characterised in that step E is followed by cooling to ambient before drying the resultant product to below about 15% moisture content.

3. The method for processing lignocellulosic precursors as claimed in claim 1 characterised in that the water activity of the lignocellulosic precursor and the steam used in processing step C are measured and/or predetermined.

4. The method for processing lignocellulosic precursors as claimed in claim 3 characterised in that the water activity of the lignocellulosic precursor determines the required water activity of the steam used.

5. The method for processing lignocellulosic precursors as claimed in claim 1 characterised in that the steam used in step C is dry, saturated or superheated, between 20 bar and 60 bar.

6. The method for processing lignocellulosic precursors as claimed in claim 1 characterised in that the processing in step C is for between 30 seconds and 5 minutes.

7. The method for processing lignocellulosic precursors as claimed in claim 1 characterised in that the dried lignocellulosic product is blended with plastic material to form a blended material, such that the plastic material makes up between 5% and 95% of the blended material.

8. The method for processing lignocellulosic precursors as claimed in claim 7 characterised in that the plastic material is one or more thermoplastic or thermosetting plastic materials.

9. The method for processing lignocellulosic precursors as claimed in claim 8 characterised in that the plastic material is a thermoplastic selected from polyethylene and polypropylene with or without additional compatible additives.

10. The method for processing lignocellulosic precursors as claimed in claim 7 characterised in that the blended material is extruded to form pellets or granules.

11. The method for processing lignocellulosic precursors as claimed in claim 10 characterised in that the pellets or granules are used for blow or injection moulding.

* * * * *